US009141077B2

(12) United States Patent
Sugiyama

(10) Patent No.: US 9,141,077 B2
(45) Date of Patent: Sep. 22, 2015

(54) IMAGE FORMING APPARATUS INCLUDING A MOVABLE EXPOSURE UNIT

(71) Applicant: BROTHER KOGYO KABUSHIKI KAISHA, Nagoya-shi, Aichi-ken (JP)

(72) Inventor: Yosuke Sugiyama, Gifu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 103 days.

(21) Appl. No.: 13/840,571

(22) Filed: Mar. 15, 2013

(65) Prior Publication Data

US 2013/0259521 A1 Oct. 3, 2013

(30) Foreign Application Priority Data

Mar. 29, 2012 (JP) ..... 2012-077204
Mar. 29, 2012 (JP) ..... 2012-077495

(51) Int. Cl.
*G03G 21/00* (2006.01)
*G03G 21/16* (2006.01)

(52) U.S. Cl.
CPC ..... *G03G 21/1666* (2013.01); *G03G 21/1633* (2013.01); *G03G 21/1647* (2013.01); *G03G 2221/1636* (2013.01)

(58) Field of Classification Search
CPC ..... G03F 15/04054; G03F 21/1628; G03F 21/1633; G03F 21/1666; G03F 2215/0409; G03F 2221/1636
USPC ..... 399/110, 118, 125; 347/117, 118, 138, 347/242, 245, 257, 263
See application file for complete search history.

(56) References Cited

U.S. PATENT DOCUMENTS

| | | | | |
|---|---|---|---|---|
| 5,089,846 | A | 2/1992 | Tabuchi | |
| 6,809,752 | B2 | 10/2004 | Nagamine | |
| 7,187,501 | B2 | 3/2007 | Wakisaka | |
| 7,825,946 | B2 * | 11/2010 | Sugiyama et al. | 347/242 |
| 7,840,159 | B2 * | 11/2010 | Nakashima | 399/117 |
| 7,982,761 | B2 * | 7/2011 | Yokoi | 347/242 |
| 8,040,368 | B2 * | 10/2011 | Yokoi | 347/242 |
| 8,126,356 | B2 * | 2/2012 | Watanabe et al. | 399/110 |

(Continued)

FOREIGN PATENT DOCUMENTS

| | | | |
|---|---|---|---|
| JP | H04-096082 | A | 3/1992 |
| JP | H06-207469 | A | 7/1994 |

(Continued)

OTHER PUBLICATIONS

U.S. Patent & Trademark Office, Office Action for U.S. Appl. No. 12/547,848, mailed Jan. 4, 2012.

(Continued)

*Primary Examiner* — Robert Beatty
(74) *Attorney, Agent, or Firm* — Merchant & Gould PC

(57) ABSTRACT

An image forming apparatus, which includes a main frame having an opening, a cover rotatable between an opened position where the cover uncovers the opening and a closed position where the cover closes the opening, a holder rotatably supported by the cover and having a recess, and an exposure unit having a plurality of light emitting elements and a supporting wall, and held by the holder, the supporting wall having a first engaging portion which engages with the recess of the holder when the cover is located at the opened position, and which disengages from the recess of the holder when the cover is located at the closed position.

12 Claims, 13 Drawing Sheets

(56) References Cited

U.S. PATENT DOCUMENTS

| | | | | |
|---|---|---|---|---|
| 8,238,764 | B2 * | 8/2012 | Funahashi | 399/12 |
| 8,310,515 | B2 | 11/2012 | Yokoi et al. | |
| 8,576,265 | B2 * | 11/2013 | Tamaru et al. | 347/138 |
| 2010/0053585 | A1 | 3/2010 | Yokoi et al. | |
| 2013/0259517 | A1 * | 10/2013 | Mori | 399/110 |

FOREIGN PATENT DOCUMENTS

| | | | | |
|---|---|---|---|---|
| JP | 08318661 | A | * | 12/1996 |
| JP | H08-318661 | A | | 12/1996 |
| JP | 2002-311662 | A | | 10/2002 |
| JP | 2003-112446 | A | | 4/2003 |
| JP | 2004-177824 | A | | 6/2004 |
| JP | 2007-065125 | A | | 3/2007 |
| JP | 2010-052155 | A | | 3/2010 |
| JP | 2011000780 | A | * | 1/2011 |
| JP | 2011090198 | A | * | 5/2011 |
| JP | 2011-154236 | A | | 8/2011 |

OTHER PUBLICATIONS

Japan Patent Office, Notice of Reasons for Rejection for Application No. JP 2008-216613, mailed Aug. 31, 2010.

* cited by examiner

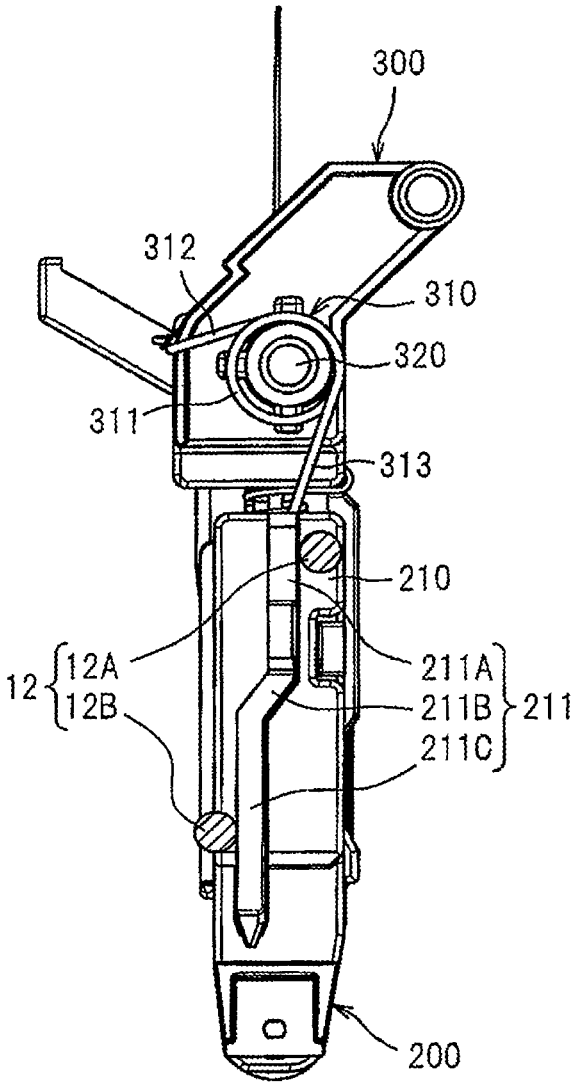
FIG. 6A
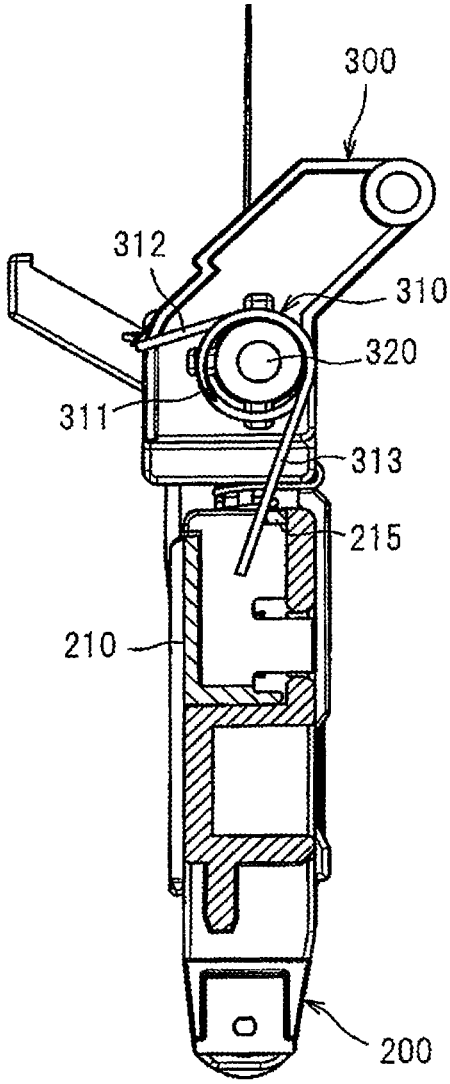
FIG. 6B
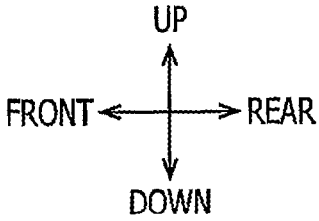

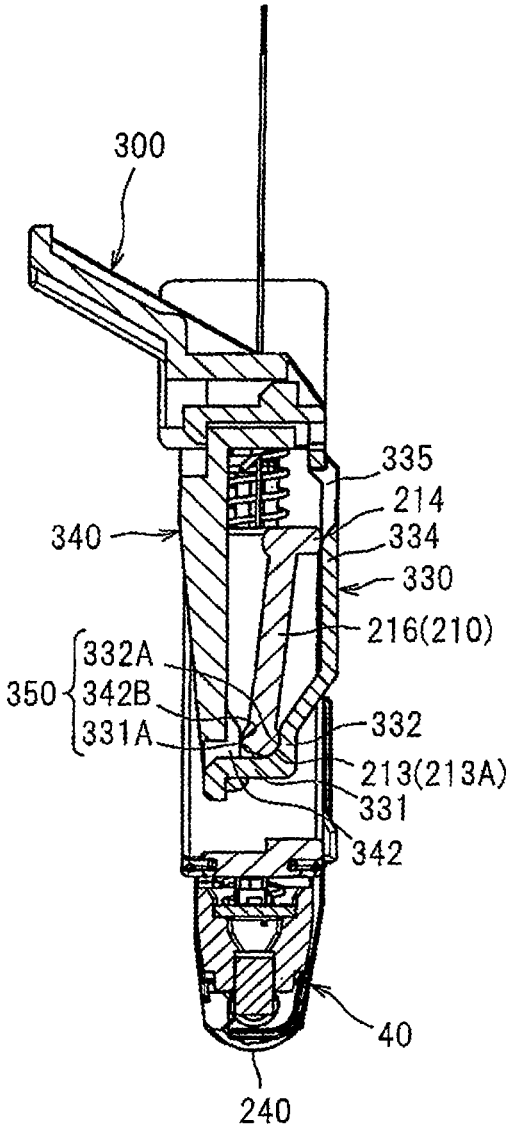
FIG. 8A
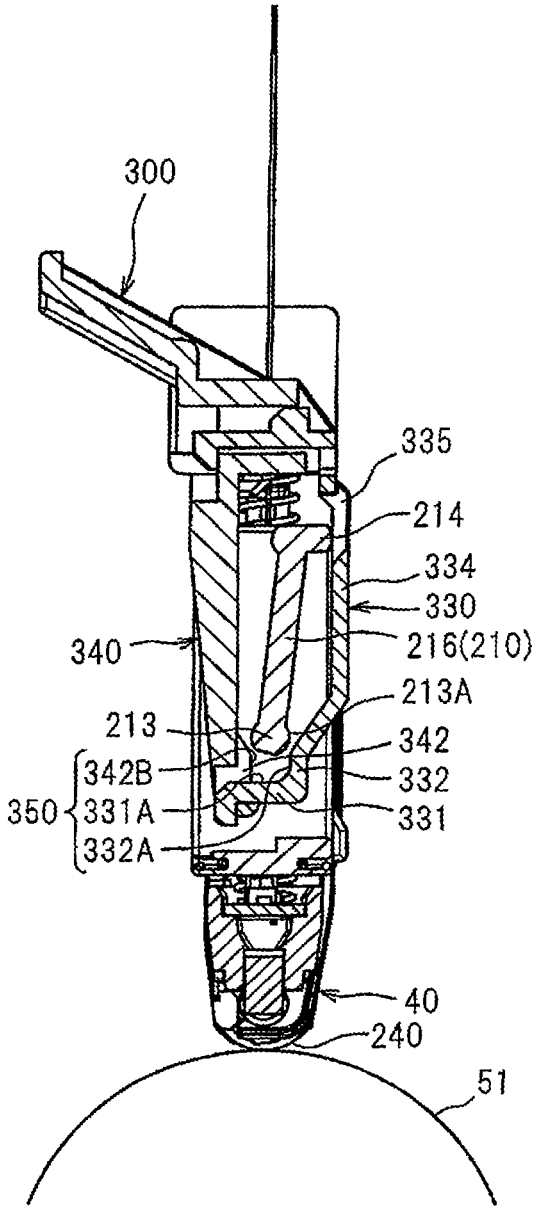
FIG. 8B
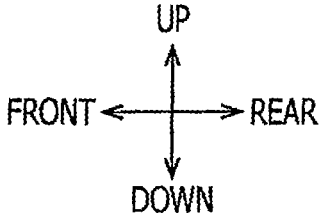

IMAGE FORMING APPARATUS INCLUDING A MOVABLE EXPOSURE UNIT

CROSS-REFERENCE TO RELATED APPLICATIONS

This application claims priority under 35 U.S.C. §119 from Japanese Patent Applications No. 2012-077204 and No. 2012-077495, both filed on Mar. 29, 2012. The entire disclosures of the applications are incorporated herein by reference.

BACKGROUND

1. Technical Field

The following disclosure relates to an image forming apparatus provided with an exposure unit.

2. Prior Art

Conventionally, an image forming apparatus provided with an exposure unit has been known. In such an image forming apparatus, problems as indicated below have been known.

There has been an image forming apparatus having a housing, which is formed with an opening, a cover capable of closing the opening, a holding member provided to the cover and support an exposure unit with a predetermined play. Typically, in such an image forming apparatus, hooks are provided to the holding member, and the exposure unit is hung from the holding member as the hooks engage with a part of the exposure unit.

Each of the hooks has a supporting surface on which the exposure unit is supported, a protrusion which protrudes upwardly is formed, while the exposure unit has a hole in which the protrusion is received. When the cover is opened/closed, that is, when the exposure unit is in a state where it is being supported by the hooks, the exposure unit does not move relative to the holding member as the protrusion engages with the hole.

In known art as described above, when the cover is closed, the exposure unit is supported by a photoconductive drum, thereby the holding member is moved downward with respect to the exposure unit. Then, the protrusion is disengaged from the hole and the exposure unit becomes movable with respect to the holding member in an auxiliary scanning direction. With this structure, when the cover is closed, a unit-side positioning portion formed on the exposure unit is abutted, in the auxiliary scanning direction, against a housing-side positioning portion so that the exposure unit is appropriately positioned with respect to the housing.

In the above-described image forming apparatus, however, when the cover is moving (i.e., being closed/opened), the protrusion is inserted in the hole, which prevents relative movement between the exposure unit and the holding member in the auxiliary scanning direction. Since the exposure unit does not move with respect to the holding member, the unit-side positioning portion and the housing-side positioning portion may interfere with each other when the cover is being moved.

There has also been known an image forming apparatus having an exposure unit as indicated below. The exposure unit has an LED head provided with a plurality of LEDs (light emitting diodes), and an LED holder which supports the LED head via a plate spring. In this conventional art, a casing of the LED head and the LED holder are made of resin, while the plate spring is made of metal.

Since the plate spring is made of metal, it is necessary that a conducting member which grounds (i.e., connects the plate spring to the earth) should be provided to the LED holder. That is, the LED holder should be formed to have a sufficient space in which such a conducting member is arranged. Therefore, the LED holder is upsized and the image forming apparatus is also upsized.

SUMMARY

In consideration of the above problems, an aspect of the invention provides an image forming apparatus which is capable of preventing the exposure unit-side positioning portion and the housing-side positioning portions from interfering with each other.

Another aspect of the invention provides an image forming apparatus provided with an LED head, an LED holder and a plate spring, and formed compact in size.

According to aspects of the present invention, there is provided an image forming apparatus, which is provided with a main frame having an opening, and a cover rotatably supported by the main frame, the cover being rotatable between an opened position where the cover uncovers the opening and a closed position where the cover closes the opening. The cover includes an exposure unit having a plurality of light emitting elements, and a holding member holds the exposure unit, and the exposure unit includes a unit side first positioning part configured to be abutted against a frame side first positioning part formed on, the main frame, the unit side first positioning part is defined as a positional relationship in an auxiliary scanning direction between the main frame and the exposure unit when the unit side first positioning part contacts the frame side first positioning part. The exposure unit also includes a first engaging part having a curved surface. The holding member has a first regulation part having a recessed portion in which the first engaging part configured to be received. Further, the exposure unit is movable in the auxiliary scanning direction with respect to the holding member as the first engaging part is disengaged from the first regulation part when the cover is located at the closed position. Furthermore, movement of the first engaging part in the auxiliary scanning direction is restricted as the first engaging part enters in the first regulation part and supported thereby when the cover is located at the opened position and the exposure unit is swingable about the first engaging part when the cover is located at the opened position.

According to the above configuration, the exposure unit is rockable when the cover is located at the opened position. When the cover is moved from the opened position to the closed position, if the unit side first positioning part is about to interfere with the frame side first positioning part, the exposure unit rocks and the interference can be suppressed.

According to aspects of the invention, there is provided an image forming apparatus, which is provided with an elongated exposure unit having a plurality of light emitting elements configured to emit light onto a photoconductive member and a holding case configured to hold the plurality of light emitting elements, the holding case being made of resin, and a supporting frame configured to support the exposure unit via an elastic member, the supporting member and the elastic member being made of resin.

According to the above configuration, in comparison with a case where the elastic member is formed of metal, conductive members to ground the elastic member and a space for accommodating such conductive members are unnecessary, and the device can be downsized.

According to aspects of the invention, there is provided an image forming apparatus, which includes a main frame having an opening, a cover rotatable between an opened position where the cover uncovers the opening and a closed position where the cover closes the opening, a holder rotatably supported by the cover and having a recess, and an exposure unit having a plurality of light emitting elements and a supporting wall, and held by the holder, the supporting wall having a first engaging portion which engages with the recess of the holder when the cover is located at the opened position, and which disengages from the recess of the holder when the cover is located at the closed position.

BRIEF DESCRIPTION OF THE ACCOMPANYING DRAWINGS

FIG. 1 schematically shows a side view illustrating a basic structure of a color printer according to an embodiment of the invention.

FIG. 2 schematically shows a side view of the color printer according to the embodiment of the invention, when a top cover is opened.

FIG. 6A is a side view showing a relationship between a unit side first positioning portion and frame side first positioning portion.

FIG. 6B is a side view showing a portion around a torsion spring.

Figure 7:
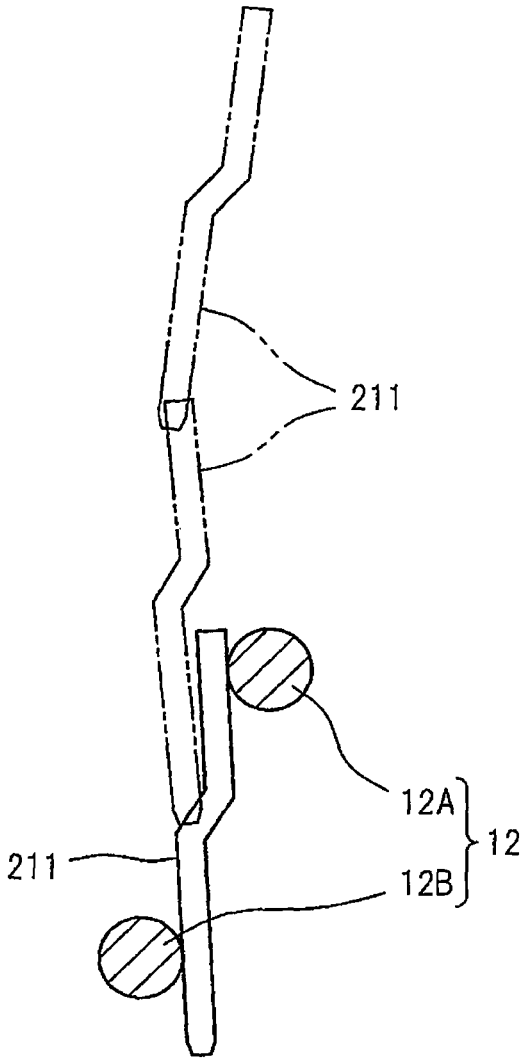

FIG. 7 schematically shows how the unit side first positioning portion enters the frame side first positioning portion.

FIG. 8A is a cross-sectional view of a first engaging portion when the top cover is located at an opened position.

FIG. 8B is a cross-sectional view of the first engaging portion when the top cover is located at a closed position.

Figure 9:
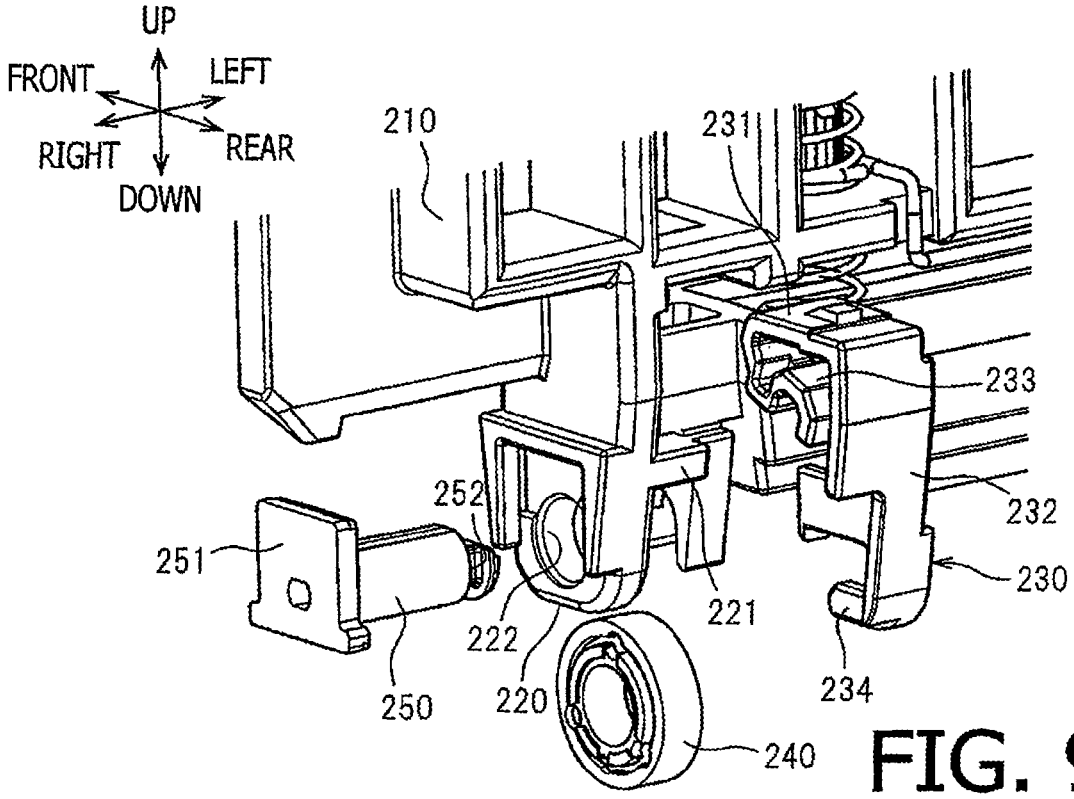

FIG. 9 is a partially enlarged perspective view showing a structure around an extended portion.

Figure 10:
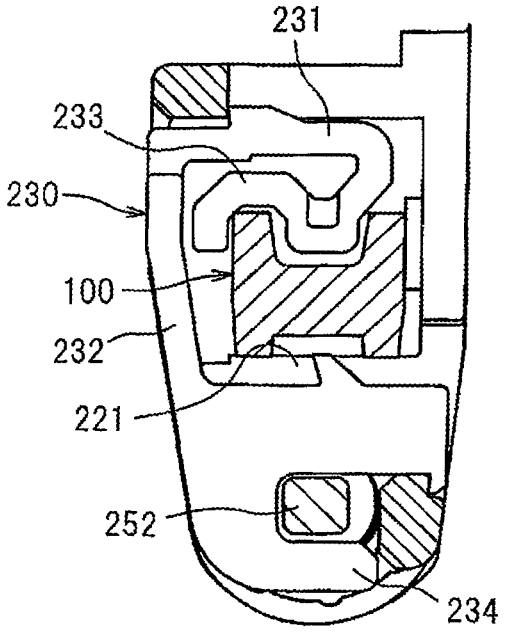

FIG. 10 is a cross-sectional view of a deformable portion of an auxiliary supporting member taken along a plane perpendicular to a right-and-left direction.

Figure 11:
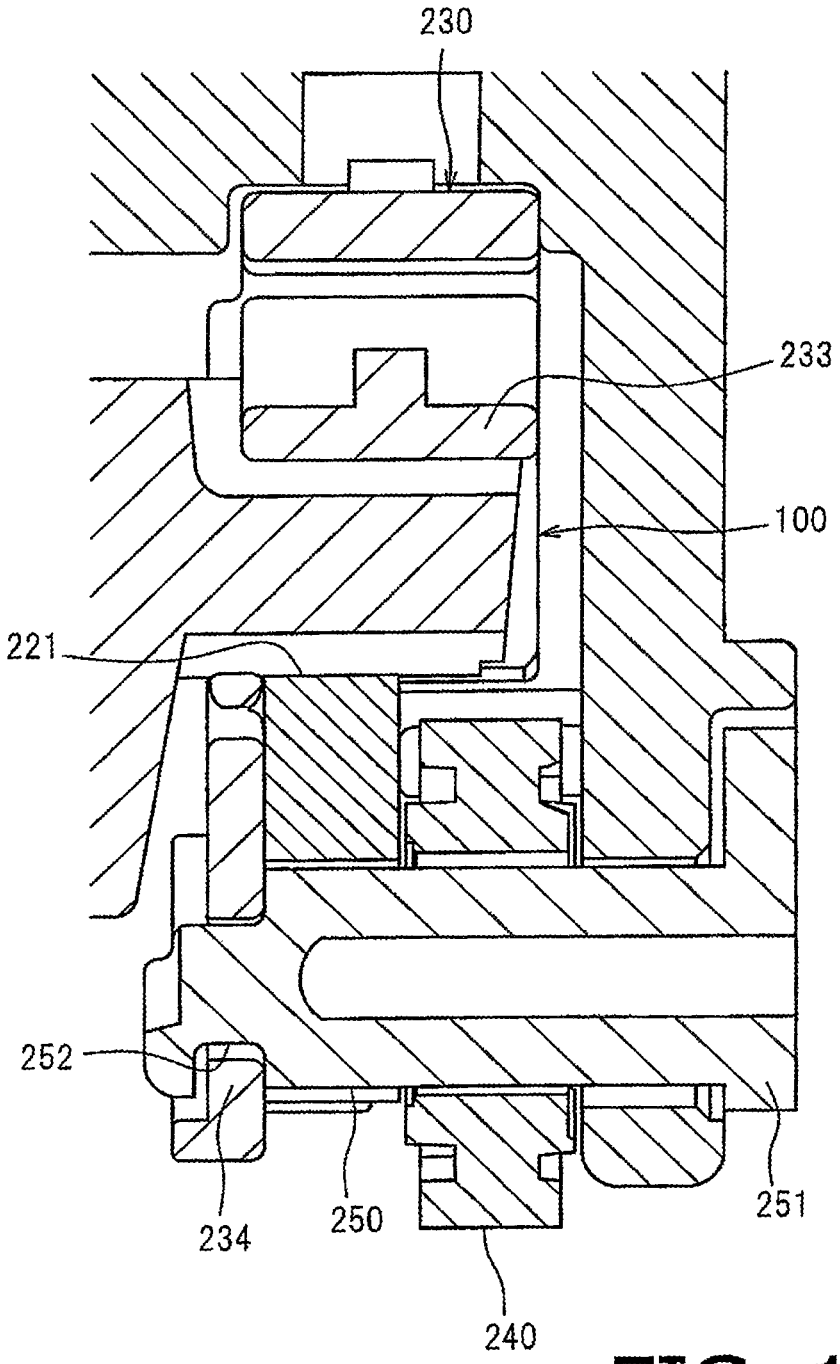

FIG. 11 is a cross-sectional view of the deformable portion of the auxiliary supporting member taken along a plane perpendicular to a front-and-rear direction.

Figure 12A:
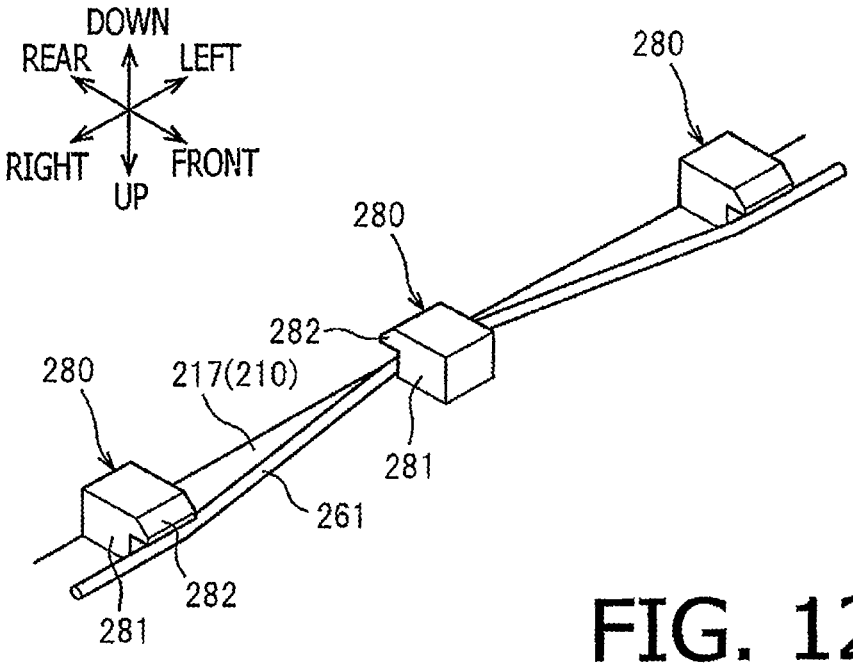

FIG. 12A is a perspective view schematically showing an arrangement of hook sections.

Figure 12B:
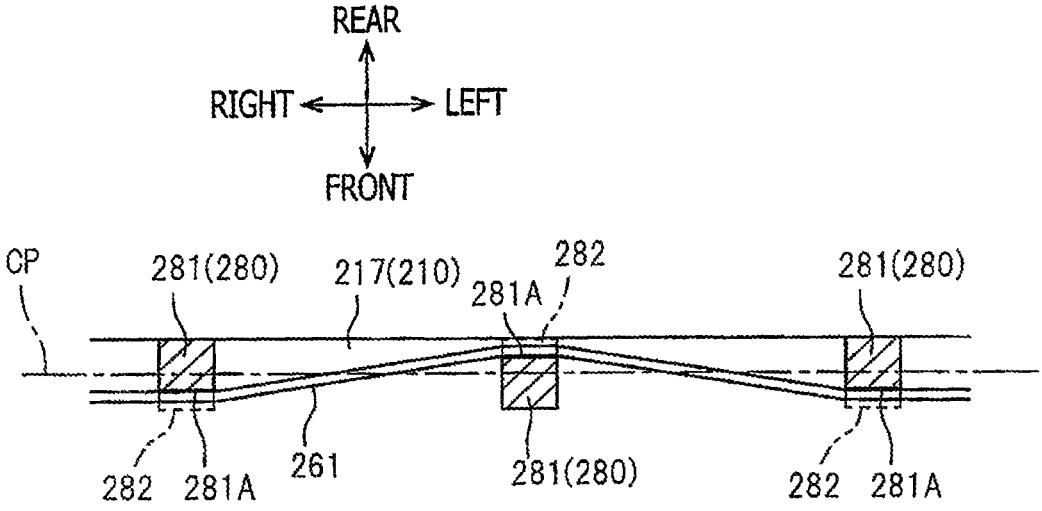

FIG. 12B is a plan view schematically showing an arrangement of the hook sections.

Figure 13:
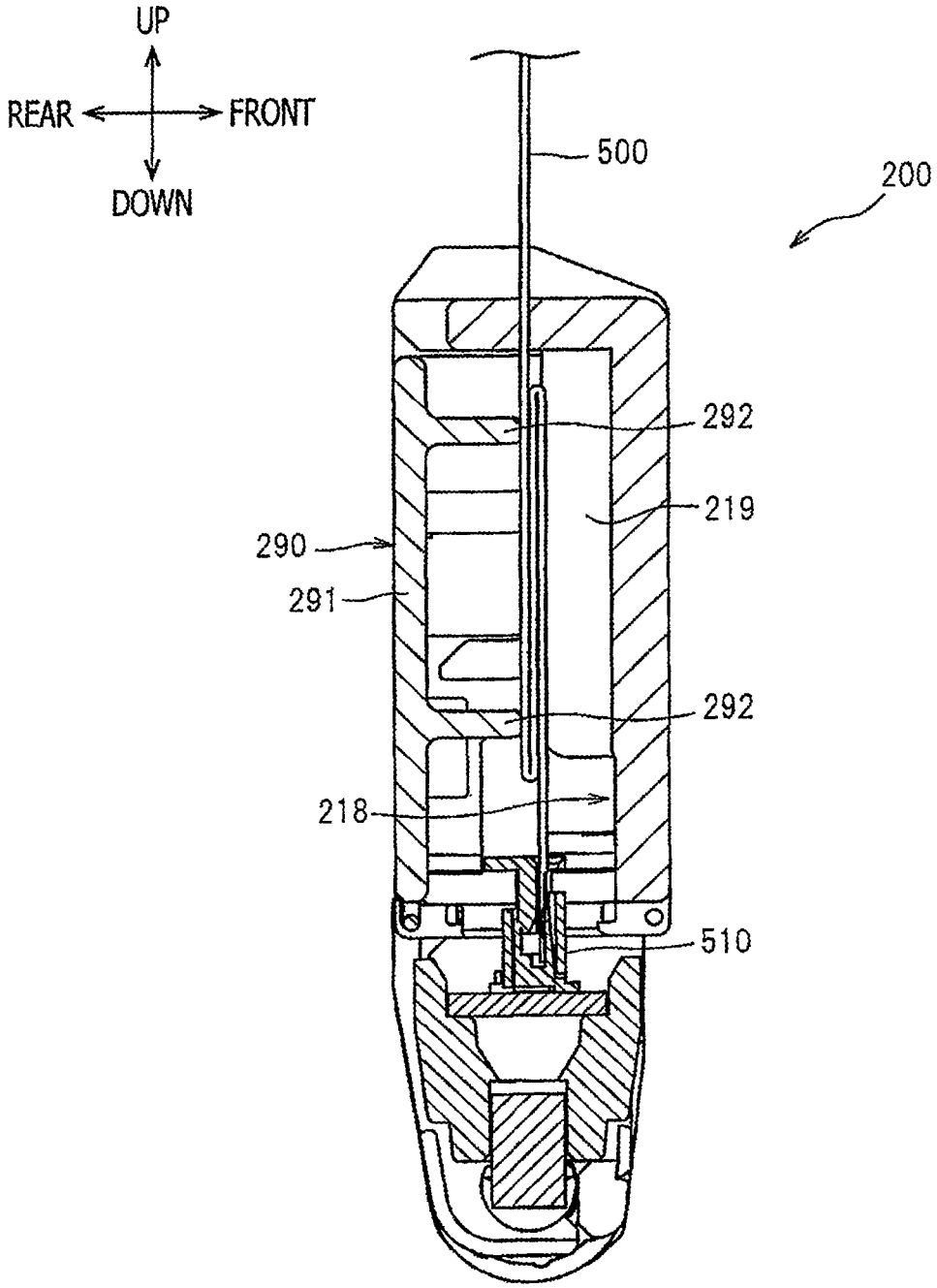

FIG. 13 is a cross-sectional view showing a structure of a harness cover.

Figure 14:
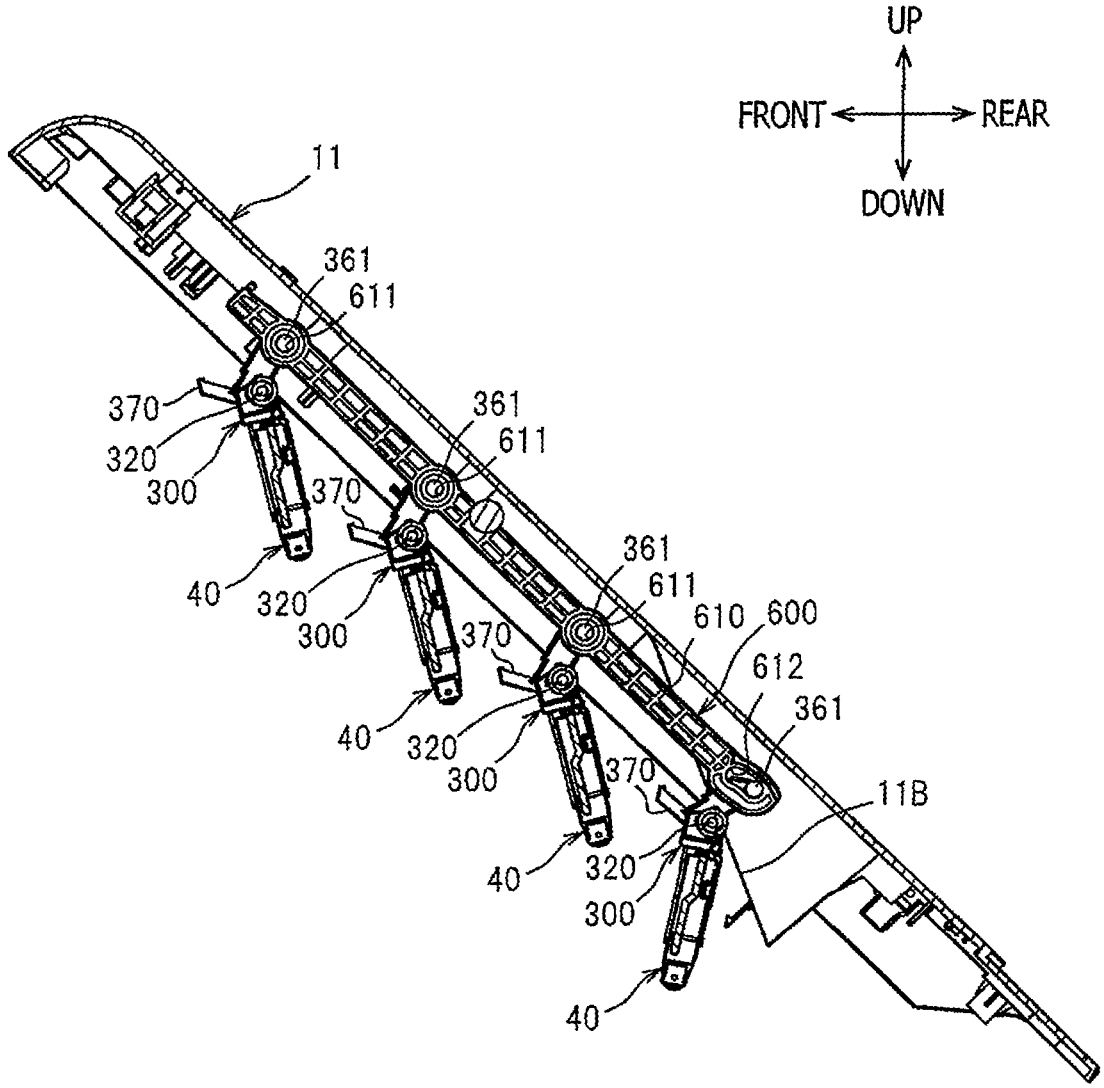

FIG. 14 is a side view schematically showing an interlocking mechanism.

DETAILED DESCRIPTION OF THE EMBODIMENT

Hereinafter, referring to the accompanying drawings, an embodiment according to aspects of the invention will be described. In the following description, a color printer 1 will be described, and then characteristic features will be describe in detail.

Figure 1:
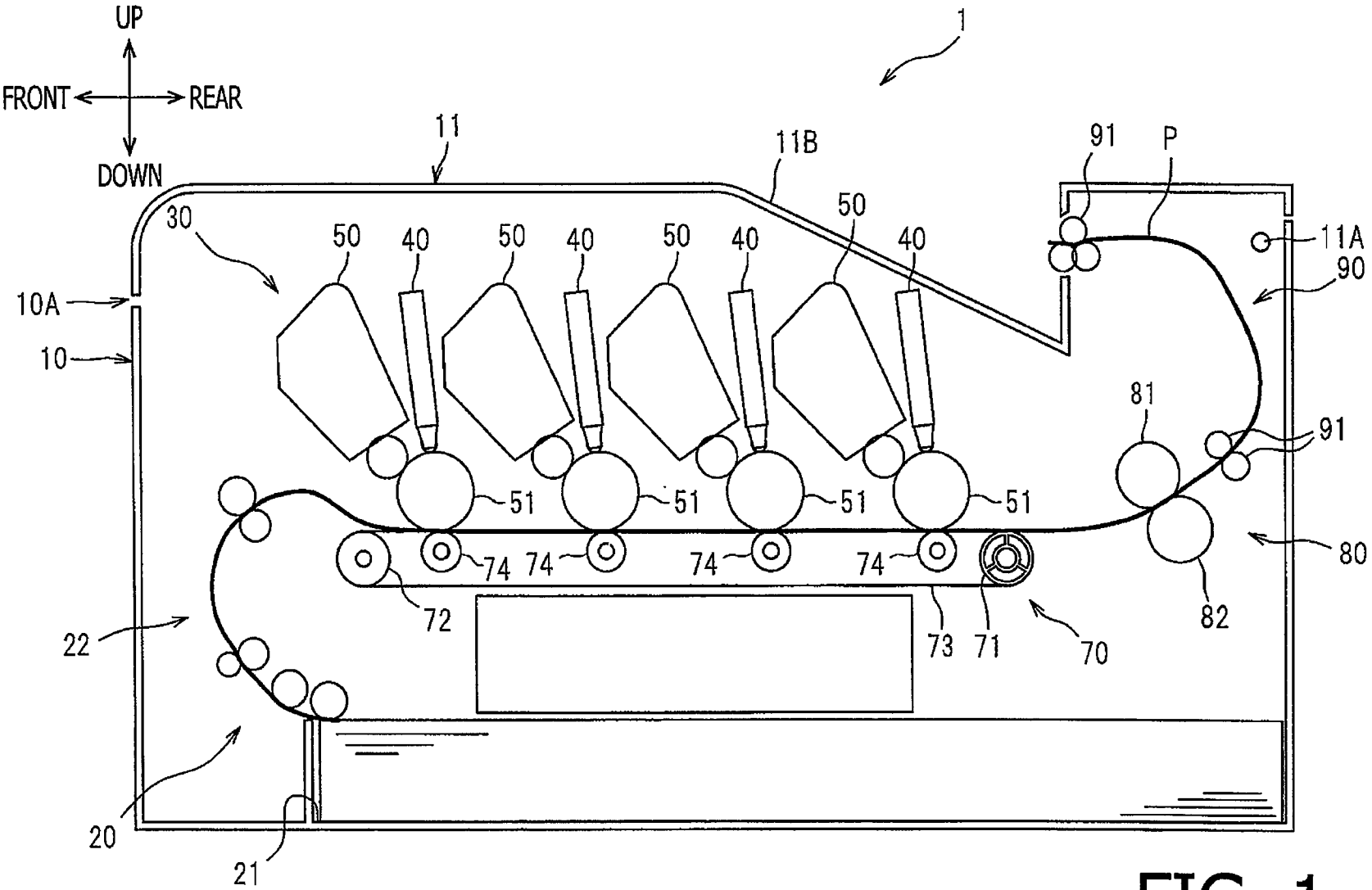

In the following description, directions are defined with respect to a user who uses the color printer 1. In FIG. 1, a left-hand side is defined as a "front" side, a right-hand side is defined as a "rear" side, a farther side and a closer side with respect to a plane of FIG. 1 are defined as a "left" side and a "right" side, respectively, and an up and a down side in FIG. 1 are defined as an "up" side and a "down" side, respectively.

As shown in FIG. 1, the color printer 1 has a main frame 10, and a top cover 11, a sheet feed unit 20 and image forming unit 30 which are provided inside the main frame 10.

The top cover 11 is provided above the main frame 10. The top cover 11 is rotatable, relative to the main frame 10, about a rotation shaft 11A which is provided on the rear side of the main frame 10 to open/close an opening 10A formed on an upper surface of the main frame 10. Specifically, the top cover 11 is rockable (movable) between a closed position (i.e., a position shown in FIG. 1) where the top cover 11 closes the opening 10A and an opened position (i.e., a position shown in FIG. 2) where the top cover 11 opens (i.e., does not cover) the opening 10A.

The sheet feed unit 20 is provided below the main frame 10. The sheet feed unit 20 includes a sheet feed tray 21, and a sheet supplying mechanism 22. The sheet feed tray 21 accommodates a plurality of sheets P. The sheet supplying mechanism 22 picks up the sheets P one by one, which is supplied to the image forming unit 30.

The image forming unit 30 has four LED units (exposure units) 40, four process cartridges 50, a transfer unit 70 and a fixing unit 80.

The LED unit 40 is configured such that a plurality of LEDs are arranged at a tip end thereof. The LED unit 40 is held by the top cover 11 (specifically, by a holder 300 which is described later) such that the LED unit 40 is hanged from the top cover 11. When the top cover 11 is closed, the LED unit 40 is located above a photoconductive drum 51 to face the same. As the plurality of LEDs are controlled to emit light based on image data, a circumferential surface of the photoconductive drum 51 is exposed so that a latent image is formed thereon. The structure of the LED unit 50 will be described later.

Figure 2:
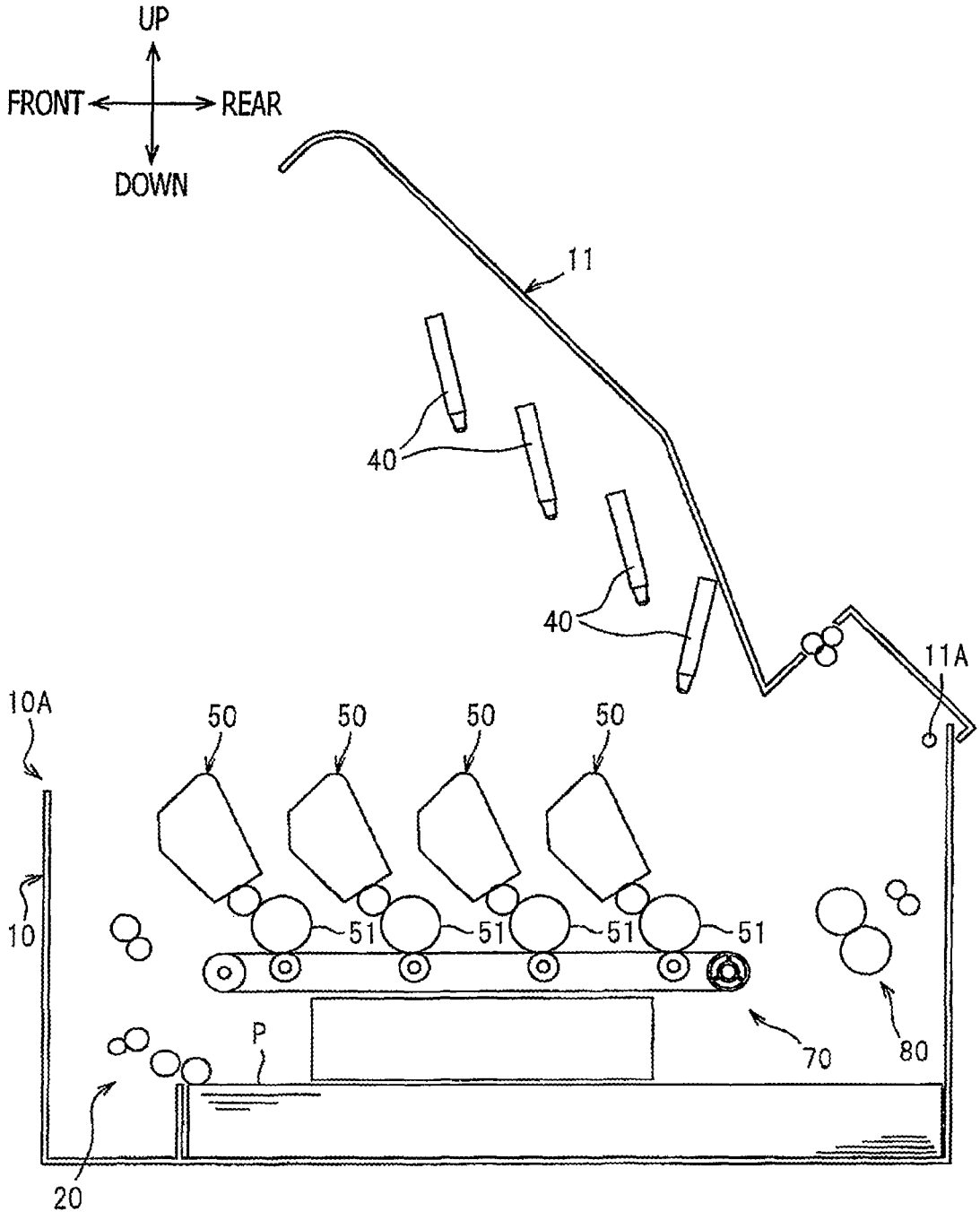

The process cartridges 50 are parallely arranged in the front-and-rear direction between the top cover 11 and the sheet feed tray 21. Each process cartridge 50 is disposed in the main frame 10 and can be detached from and attached to the main frame 10 through the opening 10A when the top cover 11 is opened as shown in FIG. 2. Each process cartridge 50 has a well-known configuration, and has a photoconductive drum 5, a charging device (not shown), a developing roller, a toner chamber and the like.

The transfer unit 70 is arranged between the sheet feed tray 21 and the process cartridges 50. The transfer unit 70 has a driving roller 71, a driven roller 72, an endless feeding belt 73 which is wound around the driving roller 71 and the driven roller 72, and four transfer rollers 74. The feeding belt 73 is arranged such that an outer surface contacts each photoconductive drum 51. The four transfer rollers 74 are arranged on the inner side of the feeding belt 73 such that each transfer roller 74 and a corresponding (i.e., facing) photoconductive drums 51 sandwiches the feeding belt 73 therebetween.

The fixing unit 80 is arranged on a rear side of the process cartridge 50 and the transfer unit 70. The fixing unit 80 has a heat roller 81 and a pressure roller 82 which is arranged to face the heat roller 81 and urged toward the heat roller 81.

In the image forming unit 30 configured as above, the circumferential surface of the photoconductive drums 51 are uniformly charged with the charging deices and then exposed to the light emitted by the LED units 40, thereby electrostatic latent images are formed, based on image data, on the photoconductive drums 51, respectively. Then, the toner is supplied to the photoconductive drums 51 from the developing rollers, the latent images are developed (i.e., toner images are formed on the photoconductive drums 51), respectively.

The toner images formed on the respective photoconductive drum 51 are subsequently overlaid on a print sheet P as the print sheet P is fed from the sheet feed unit 20 and further fed between the photoconductive drums 51 and the feeding belt 73. The print sheet P on which the toner images are transferred are fed through a nip between the heat roller 81 and the pressure roller 82, thereby the toner image being fixed on the print sheet P. Thereafter, the print sheet P is ejected, by the feed roller 91, from the main frame 10, and stacked on a ejected sheet tray 11B which is formed on the top cover 11.

As shown in FIGS. 3-5A, 5B, the LED unit 40 has an elongated LED head 100 and a support frame 200 which is made of resin and supports the LED head 100. The LED unit 40 is hanged by a resin holder 300.

The LED head 100 has a holding case 110 made of resin, a plurality of LED arrays which is configured such that a plurality of LEDs are arranged on a semiconductor chip, and a lens array 120 which is arranged below the plurality of LED arrays and held by the holding case 110. According to the exemplary embodiment, the plurality of LEDs and the lens array 120 constitute a plurality of light emitting unit.

At an upper portion inside the holding case 110, a substrate 130 (see FIG. 4) configured to control the LED array is arranged such that a part of the substrate 130 is exposed upwardly from the holding case 110.

The supporting frame 200 has a base portion 210 extending in the right-and-left direction, and a pair of extended parts 220 which extend downward from both ends, in the right-and-left directions, of the base portions 210.

The base portion 210 has a unit-side first positioning part 211, a unit-side second positioning part 212, a pair of right and left first engaging parts 213, and a pair of right and left second engaging parts 214.

As shown in FIG. 6A, the unit side first positioning part 211 is a part which is engaged with the frame side first positioning part 12 provided to the frame 10 for positioning the LED unit with respect to the main frame 10 in the front-and-rear direction (i.e., in the auxiliary scanning direction). The unit side first positioning part 211 is formed to protrude, in the right-and-left direction, from the right side surface of the base portion 210. Specifically, the unit side first positioning member is formed to have a plate-like shape extending substantially in the up-and-down direction. The unit side first positioning part 211 has an upper section 211A extending downward from the upper end of the base portion 210, an intermediate section 211E extending obliquely downward from the lower end of the upper section 211A, and a lower section 211C extending downward from the lower end of the intermediate section 211B.

The frame side first positioning part 12 has a first boss 12A which engages with the upper section 211A of the unit side first positioning part 211 from the rear side (i.e., one side in the auxiliary scanning direction), and a second boss 12B which engages with the lower section 211C of the unit side first positioning part 211 from the front side (i.e., the other side in the auxiliary scanning direction). Between (mechanically) the supporting frame 200 and the holder 300, a torsion spring 310 urging an upper end portion of the supporting frame 200 rearward (i.e., in the auxiliary scanning direction) is provided.

Specifically, the torsion spring 310 has, as shown in FIG. 6B, a coil portion 311 which is arranged to surround a rotational shaft 320 of the holder 300, a first arm 312 and a second arm 313 extending outward from the coil portion 311. The torsion spring 310 is configured such that a distal end of the first arm 312 is secured to (engaged with) the holder 300, and a distal end of the second arm 313 engages with an urged part 215 defined at an upper end of the base portion 210 from the front side.

Specifically, the urged part 215 is arranged at a higher level than a portion where the base portion 210 contacts the first boss 12A, and the urged part 215 is biased rearward by the torsion spring 310. Since the torsion spring 310 urges the urged part 215 rearward, the upper section 211A of the unit side first positioning part 211 closely contacts the first boss 12A, and the base portion 210 rotates clockwise about the first boss 12A. Therefore, the lower part 2110 of the unit side first positioning part 211 closely contacts the second boss 12B and stable positioning is enabled.

Figure 4:
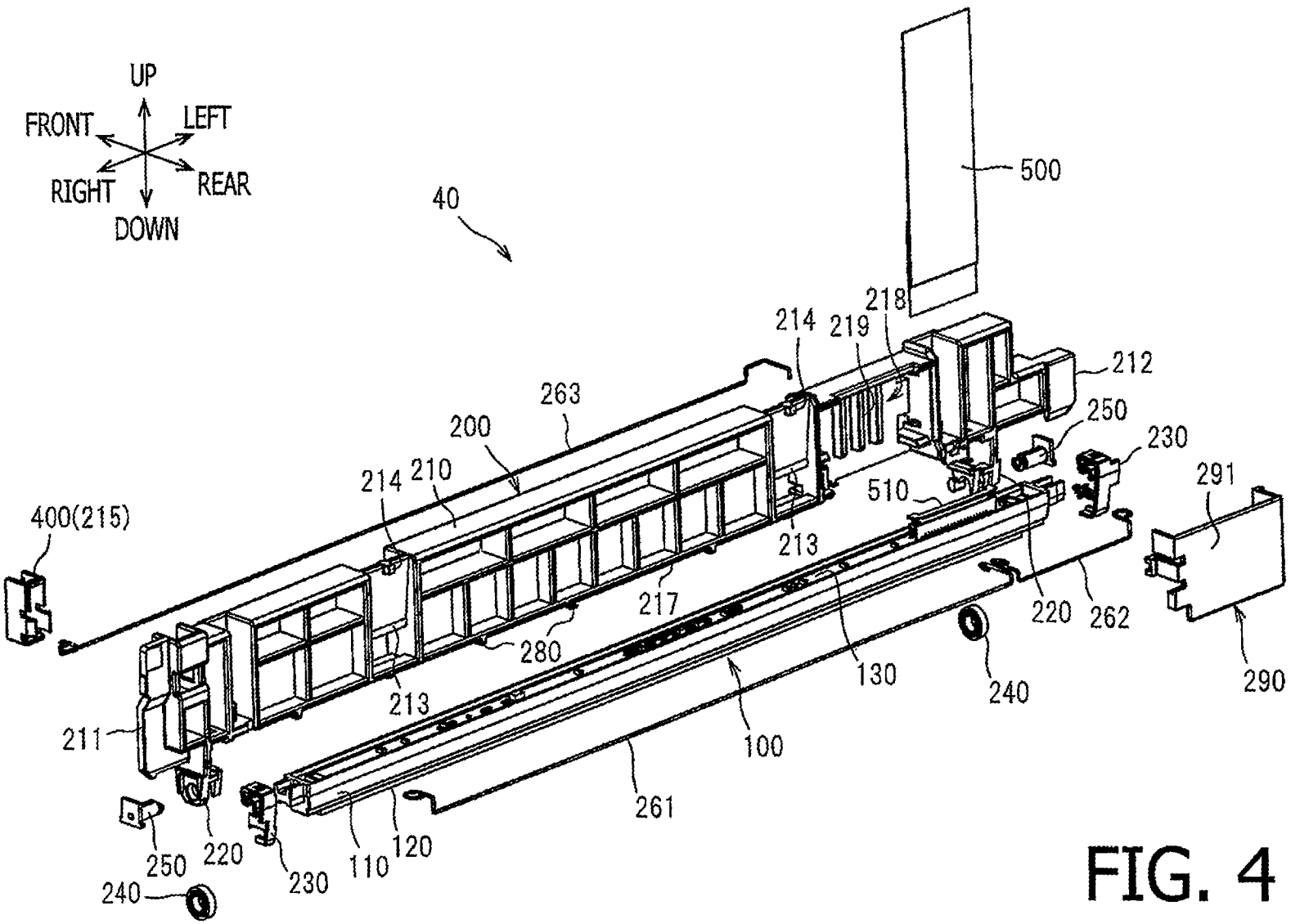
FIG. 4 is an exploded perspective view of the LED unit according to the embodiment of the invention.

According to the embodiment, the urged part 215 is formed on a urged member 400 which is provided separately from the supporting frame 200 (see FIG. 4). The urged member 400 is made of material (e.g., POM) which has less wearing characteristic than the supporting frame 200. Therefore, if the torsion spring 310 and the urged part 215 slide contact each other as the LED unit 40 moved relative to the holder 300, the wearing of the urged part due to the slide contact can be suppressed.

Further, as shown in FIG. 6B, the torsion spring 310 is configured to urge the urged part 215 not only rearward, but downward. In other words, the torsion spring 310 is configured to urge the urged part 215 obliquely downward.

Therefore, when the top cover 11 is rotated from the opened position toward the closed position, an urging force having a component downwardly directed (i.e., in the direction in which the LED unit 40 is movable) is generated by the torsion spring 310. Therefore, as shown in FIG. 7, when the positioning part 211 is inserted between the first boss 12A and the second boss 12B. In this case, even if a frictional force is generated between the unit side first positioning part 211 and the frame side first positioning part 12, the urging force can be applied so as to prevail against the frictional force. Therefore, it is ensured that the unit side first positioning part 211 is abutted against the frame side first positioning part 12.

Figure 3:
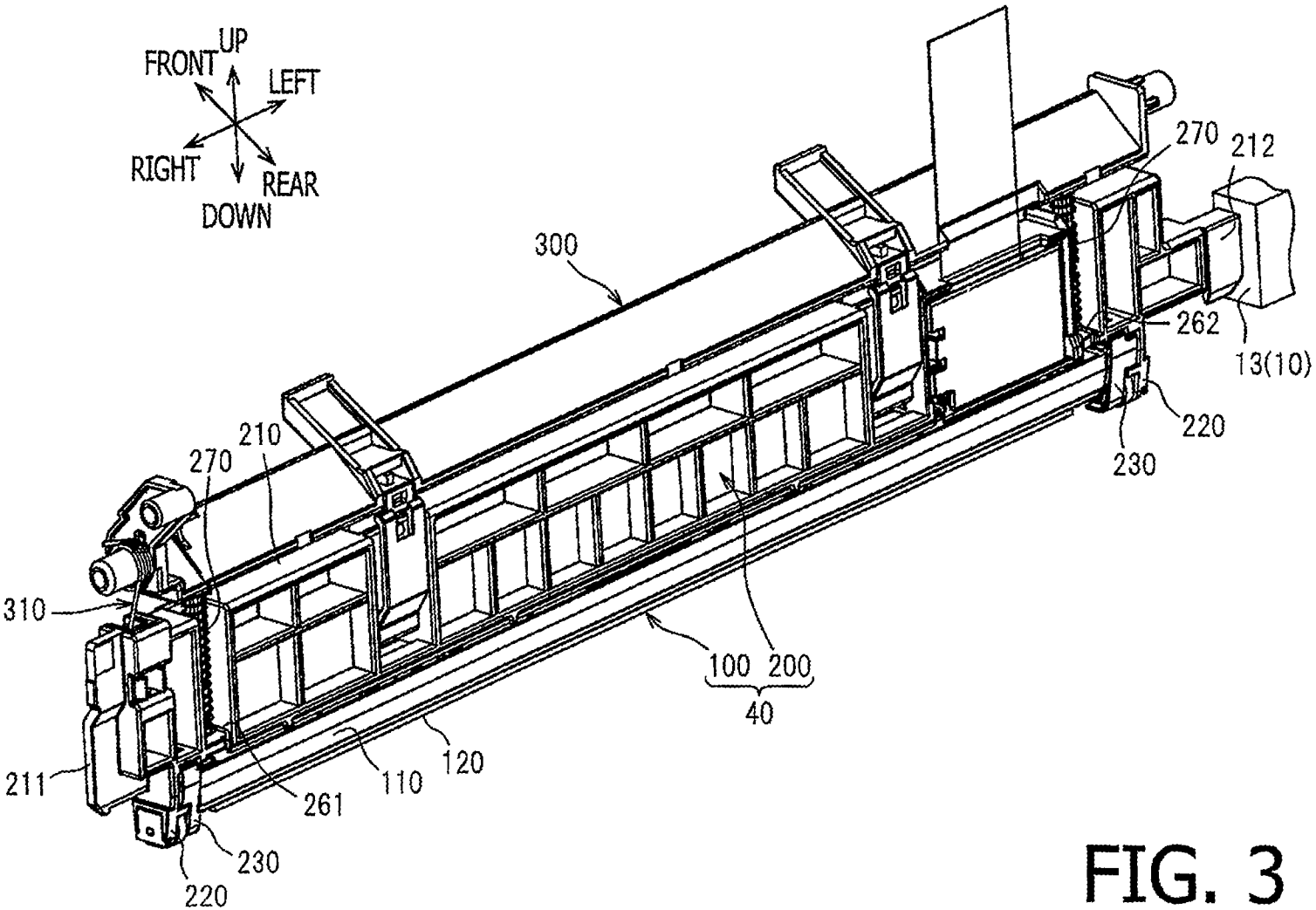
FIG. 3 is a perspective view showing an LED unit and a holder which are assembled to each other.

As shown in FIG. 3, the unit side second positioning part 212 is a part to contact a frame side second positioning part 13 formed on the frame 10 so as to make the LED unit 40 in the right-and-left direction (i.e., the main scanning direction) in position. The unit side second positioning part 212 is formed from the base portion 210, at an end portion opposite to the unit side first positioning part 211, and outwardly extend in the right-and-left direction. The torsion spring 310 urges the base portion 210 rearward (i.e., in the auxiliary scanning direction) and also urges the base portion 210 leftward (i.e., in the main scanning direction). With this configuration, the unit side second positioning part 212 is abutted against the frame side second positioning part 13.

As described above, positioning of the LED unit 40 is done by urging the same in the front-and-rear direction and the right-and-left direction using one torsion spring. Therefore, in comparison with a case where two torsion springs are used respectively for urging the LED unit is the front-and-rear and right-and-left directions, the number of members can be reduced.

As shown in FIGS. 5A, 5B and FIGS. 8A, 8B, the right and left first engaging parts 213 of the based portion 210 are arranged at substantially symmetrical positions in the right-and-left direction with respect a center thereof. Further, each of the right and left first engaging parts 213 has a curved surface 213A on a part thereof (see FIGS. 8A and 8B). Specifically, the first engaging parts 213 are formed as an arc-shaped protrusion protruded from a lower end of a plate-like supporting wall 216 which is sandwiched by holding arms 330 and 340 provided to the holder 300.

The holding arms 330 and 340 are provided to extend downward from main body 301, which extends in the right-and-left direction, of the holder 300 at positions corresponding to the right and left first engaging parts 213. At a lower end portion 332 of each holding arm 330, a protruding piece 331 which protrudes forward, and a contact surface 332A which is to contact the rear side curved surface 213A of the corresponding first engaging part 213 are formed.

The protruding piece 331 is formed with a contact surface 331A which is to contact a lower end side of the first engaging part 213. On a lower end portion 342 of the front holding arm 340, an opening 342A through which the protruding piece 331 is inserted, and a contact surface 342B which is to contact a front end side curved surface 213A of the first engaging part 213.

The protruding piece 331 is configured to penetrate through an opening formed at a lower side of the first engaging part 213 in the front-and-rear direction, enter the opening 342A of the front holding arm 340 and contact the lower end portion 342 of the holding arm 340. The contact surfaces 332A and 342B at the lower end portions 332 and 342 of the holding arms 330 and 340 are arranged at an interval which is substantially the same as a length, in the front-and-rear direction, of the first engaging part 213.

With the above configuration, by the contact surface 332A of the holding arm 330, by the contact surface 331A of the protruding piece 331 and by the contact surface 342B of the front holding arm 340, a first regulating part 350 having a concave shape, in which the first engaging part 213 is to be inserted, is formed. As shown in FIG. 8A, the first engaging part 213 is configured to enter the first regulating part 350, when the top cover 11 is in the open position, so that the curved surface 213A is supported by the first regulating part 350.

With the above configuration, when the top cover 11 is located at the open position, a movement of the first engaging part 213 in the front-and-rear direction (i.e., auxiliary scanning direction) is regulated by the first regulating member 350, while the LED unit 40 is rockable about the first engaging part 213 (i.e., the center of the curved surface 213A). Therefore, when the top cover 11 is moved to be closed from its open position and the unit side first positioning part 211 is about to interfere with the frame side first positioning part 12, such an interference can be suppressed as the LED unit 40 rocks.

Further, according to the above configuration, it is possible to suppress members such as the roller 240 and the lens array 120 of the LED unit 40, which may cause problems in printing if damaged, and the process cartridge 50 from knocking together.

Figures 5A, 5B:
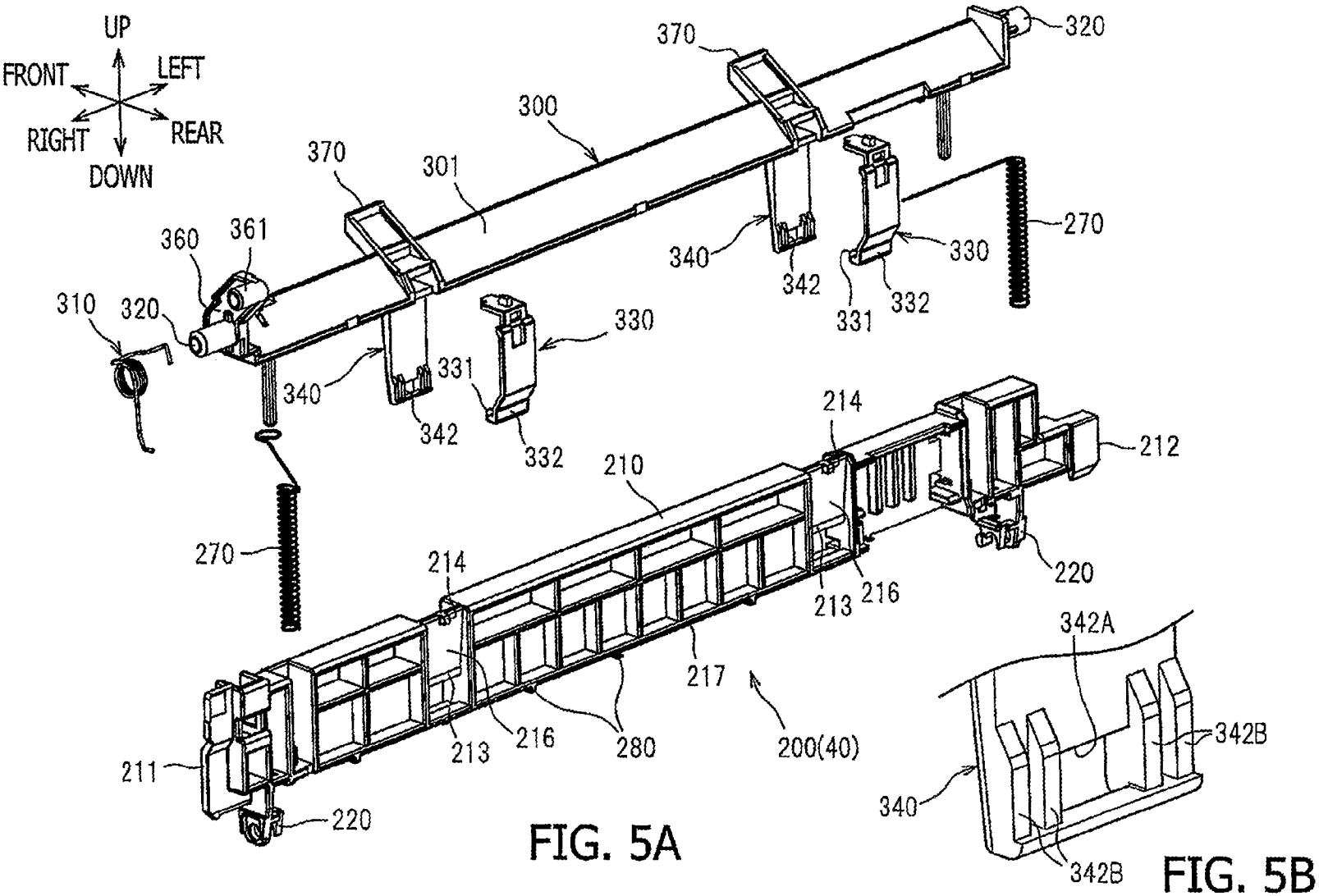
FIG. 5A is a perspective view showing a supporting frame and the LED unit.
FIG. 5B is an enlarged perspective view showing a lower portion of a front supporting arm.

Between the upper portion (i.e., a second engaging part 214 which will be described later) of the supporting wall 216 of the base portion 210 and the holder 300, a clearance is formed, in which the LED unit 40 (base portion 210) can be moveable upward, with respect to the holder 300. Therefore, when the top cover 11 is being moved to the closed position, as shown in FIG. 5B, if a lower end (i.e., the roller 240) of the LED unit 40 is abutted against the photoconductive drum 51 and the downward movement is restricted, the LED unit 40 moves upward, relatively to the downward movement of the holder 300 in association with closing movement of the top cover 11, and the first engaging part 213 is disengaged from the first regulating part 350 when the top cover 11 is located at the closed position.

As described above, when the first engaging part 213 is disengaged from the first regulating part 350, restriction of the movement of the first engaging part 213 in the front-and-rear direction by the first regulating part 350 is released, thereby the LED unit 40 being movable, with respect to the holder 300, in the front-and-rear direction. Specifically, as the first engaging part 213 is disengaged from the first regulating part 350, the second engaging part 214 is disengaged from the second regulating part 334, the LED unit 40 becomes movable, in the front-and-rear direction, with respect to the holder 300.

The second engaging part 214 is formed at an upper end portion of the supporting wall 216, that is, at a portion displaced from the first engaging part 213 in the up-and-low direction (i.e., in a direction parallel to the optical axis of the light emitted by the LED unit 40). The second engaging part 214 is protruded rearward from the supporting wall 216. The holder 300 is formed with the second regulating part 334 which contacts the rear end of the second engaging part 214 to regulate the movement of the second engaging part 214 in the rearward direction.

Above the second regulation part 334, a relief hole 335 configured to absorb the rocking movement of the LED unit 40 restricted by the contact of the second engaging part 214 with the second regulation part 334 when the top cover 11 is located at the closed position is formed.

As described above, since the second engaging part 214, the second regulating part 334 and the relief hole 335 are formed, a movement amount of the second engaging part 214 in the front-and-rear direction is smaller when the top cover is in the opened position than in the closed position. With this configuration, a trembling state of the LED unit 40 with respect to the holder 300 when the top cover 11 is opened/closed can be suppressed. Therefore, it is possible to suppress interference of the LED unit 40 with other members when the top cover 11 is opened/closed.

Further, according to the exemplary embodiment, the torsion spring 310 urges the upper portion of the based part 210 rearward. With this urging force, the second engaging part 214 is abutted onto the second regulation unit 334. Therefore, the movement of the LED unit 40 with respect to the holder 300 when the top cover is opened/closed can further be suppressed, thereby the interference of the LED unit 40 with the other members can further by suppressed.

Since the urging force of the torsion spring 310 is used for suppressing the movement of the LED unit 40 with respect to the holder 300 when the top cover 11 is opened/closed, it becomes possible to reduce clearances between adjacent process cartridges 50 which enables downsizing of the image forming apparatus.

Further, when the top cover 11 is closed, the second engaging part 214 is disengaged from the second regulation part 334. Therefore, by the urging force of the torsion spring 310, the LED unit 40 is rotated so that the unit side first positioning part 211 is closely contacted to the first boss 12A and the second boss 12B.

As shown in FIGS. 9-11, each of the extended part 220 is provided with an auxiliary support member 230 and a roller 240 which is used to retain a clearance between the lower surface (i.e., a lens surface) of the LED head 10 and the photoconductive drum 51. At an intermediate part, in the up-and-down direction, of the extending part 220 which extends in the up-and-down direction, a seat 221 configured to support the LED head 100 is formed to extend in the right-and-left direction.

Structures around the right and left extending parts 220 are symmetrical in the right-and-left direction. Therefore, in the following description, the structure around only one the pair of extending parts 220 will be described in detail.

The auxiliary support member 230 is made of resin, and has an upper wall 231, a rear wall 232 extending downward from a rear end of the upper wall 231, a deformable part 233 provided below the upper wall 231, and a protrusion part 234 extending frontward from a lower end of the rear wall 232.

The deformable part 233 is a part which is elastically deformable in the up-and-down direction. The deformable part 233 extends downward from a front end of the upper wall 231 and then extends rearward. An end portion of the deformable part 233 is formed to be a U-shaped portion having its opening oriented downward. The deformable part 233 is configured such that the U-shaped end portion urges the LED head 100 toward the seat 221.

Specifically, when the upper all 231 and the deformable part 233 of the auxiliary support member 230 are sandwiched between the base part 210 and the LED head 100 located on the seat 221, the deformable part 233 deforms, thereby the LED head 100 is urged toward the seat 221. In other words, the LED head 100 is supported by the supporting frame 200 via the auxiliary supporting member 230.

As above, as the elastic member that urges the LED head 100 toward the supporting frame 200 is made of resin, in comparison with a case where such an elastic member is made of metal, the device can be downsized since a conductive member for grounding the elastic member and a space for arranging such a conductive member are unnecessary. In particular, according to the exemplary embodiment, the resin elastic members are employed for a plurality of LED units 40, the number of members and a large amount of space can be reduced since a plurality of conductive members and the space therefor, which were necessary in a conventional configuration, are unnecessary.

The roller 240 is made of resin, and rotatably supported by a rotation shaft 250 which is also made of resin and supported by a bearing hole 222 formed on a lower portion of the extended part 220. As the supporting frame 200 is urged downward by a pair of coil springs (see FIG. 5A), the roller 240 contacts the photoconductive drum 51 and is rotated as the photoconductive drum 51 rotates (see FIG. 8B).

The rotation shaft 250 is provided to penetrates through the bearing hole 222 and a center hole formed on the roller 240. At an outer end portion, in the right-and-left direction, of the rotation shaft 250, formed is a flange part 250, which prevents the rotation shaft 250 from dropping out of the bearing hole 222 as it is displaced in the right-and-left direction.

At an inner end portion, in the right-and-left direction, of the rotation shaft 250, a groove 252 which is recessed in a radial direction is formed. With the groove 252, the protruded part 234 of the auxiliary supporting member 230 is engaged.

As described above, the protruded part 234 of the auxiliary supporting member 230 is fitted in the groove 252 of the rotation shaft 250 and the outward displacement of the rotation shaft in the right-and-left direction is restricted, thereby the rotation shaft 250 is prevented from being dropped out of the bearing hole 222. In addition to the above effect, since the protruded part 234, which serves as a member to prevent removal of the rotation shaft 250, is integrally provided to the auxiliary supporting member 230, the number of components can be reduced in comparison with a case where a member for preventing the removal of the rotation shaft 250 is provided separately.

As shown in FIG. 4, on the lower surface 217 of the base part 210 (i.e., a surface facing the LED head 100), wires 261, 262 and 263 are provided along the right-and-left direction. The wire 262 is grounded via the left-side coil spring 270, the wire 263, the right-side coil spring 270, a metal plate of the top cover 11 and a metal plate of the main frame 200. The wire 261 is grounded via the right-side coil spring 270, the metal plate of the top cover 11 and the metal plate of the main frame 200.

Specifically, the wire 263 arranged in front of the supporting frame 200, and the wire 261 arranged on the rear and right side of the supporting frame 200 are connected, to the right-side coil spring 270. Further, the wire 262 which is arranged on the rear and left side of the supporting frame 200 is connected to the left-side coil spring 270.

As described above, the wires 261, 262 and 263, which are arranged between the supporting frame 200 and the LED head 100 are grounded, discharge of static electricity from outside (e.g., user's hands) to the LED head 100 can be suppressed.

Each of the wires 261, 262 and 263 is formed to have a shorter length than a distance between the two auxiliary supporting members 230 (see FIG. 3). Specifically, the sum of the length of the rear side wires 261 and 262, or the length of the front side wire 263, in the right-and-left direction, is shorter than the distance between the two auxiliary supporting members 230.

As above, by forming the wires 261, 262 and 263 to be shorter than the distance between the two auxiliary supporting members 230, it is possible to trim weight of the device in comparison with a case where the wires are formed to be longer than the distance between the two auxiliary supporting members 230. That is, in conventional art, two auxiliary supporting members are formed of metal, and the wires should be extended to connect with the auxiliary supporting members in order to ground the same. According to the exemplary embodiment, since the auxiliary supporting members are formed of resin, it is unnecessary to ground the auxiliary supporting members, and thus, it is unnecessary to extend the wires 261, 262 and 263 to the auxiliary supporting members 230. Therefore, the wires 261, 262 and 263 can be formed shorter, which contributes to weight saving of the device.

On the lower surface 217 of the base part 210 (i.e., a surface facing the LED head 100), a plurality of hook parts 280 configured to hold the wires 261-263 are formed. As shown in FIGS. 12A and 12B, the plurality of hook parts 280 are aligned in the right-and-left direction with intervals. Each of the hook parts 280 has a base part 281 protruding downward (i.e., toward the LED head 100) from the lower surface 217 of the base part 210, and a nail part 282 protruding from the base part 281 in the front-and-rear direction (i.e., in a direction of a shorter side or narrow side of the LED head 100) to hold the wire 261.

At least three hook parts 280, which are adjoining in the right-and-left direction, among the plurality of hook parts 280 are configured such that the base parts 281 are arranged alternately in the front-and-rear direction, and the nail parts 282 thereof are formed to be directed to outer sides in the front-and-rear direction (i.e., in a direction which is away from the center CP of each hook parts 280 in the front-and-rear direction). In other words, the three adjoining hook parts 280 which adjoin in the right-and-left direction are configured such that the nail parts 282 of the hook parts 280 at both ends of the adjoining three hook parts 280 are directed toward the front side, while the nail part 281 of the central hook part 280 of the adjoining three hook parts 280 is directed toward the rear side, thereby a wire support surface 281A of the base part 281 at the center of the adjoining three hook parts 280 is displaced, in the front-and-rear direction with respect to wire support surfaces 281A of the base parts 281 at both sides the three.

With the above configuration, due to the above-described at least three hook parts 280, a part of the wire 61 is bent in S-shape. The elasticity of the S-shaped bent portion of the wire 261 urges the wire 261 to the base part 281 of the hook part 280, thereby preventing the wire 261 from disengaging from the hook part 280.

As shown in FIGS. 4 and 13, the supporting frame 200 is provided with a harness cover 290 which is made of resin and covers a harness 500 electrically connecting a frame side circuit board provided to the main frame 10 with the circuit board 130 in the LED head 100. With this configuration, discharge of static electricity from outside (e.g., user's hand) to the harness 500 can be suppressed with the harness cover 290.

Specifically, the harness cover 290 is a member which covers an opening of a harness chamber 218 which is formed on the base part 210 as a recessed portion. The harness cover 290 has a plate-like main part 291 having substantially the same size as the opening of the harness chamber 218, and a holding part 292 protruding from the main part 291 toward the harness 500. The harness 500 is folded by a plurality of times inside the harness chamber 218, and the harness 500 is held such that the folded part is sandwiched by the holding part 292 of the harness cover 290 and a plurality of ribs formed on a bottom surface of the harness chamber 219.

With the above-described configuration, even if the user pulls the harness 500 (at a portion opposite to the circuit board 130 with respect to the harness cover 290), the folded portion is extended and load to a connector 510, which is a connection between the harness 500 and the circuit board 130, can be suppressed.

As shown in FIGS. 5 and 14, there are a plurality of holders 300 respectively corresponding to the plurality of LED units 40, and the plurality of holders 300 are rotatably supported by the top cover 11 by means of the rotation shafts 320 formed at both ends (in the right-and-left direction) of the main parts 301. The plurality of holders 300 are configured such that the tip ends of the LED units 40 approaches the rotational center (i.e., rotation shaft 11A) of the top cover 11 when the top cover 11 is moved from the closed position to the opened position by means of an interlocking mechanism 600 which operates in association with open/close movement of the top cover.

Specifically, on the right side end portion of the holder 300, an extended part 360, which extends in the rear-upper direction. At an end of the extended part 360, a cylindrical joint protrusion 361 is formed. The interlocking mechanism 600 has an elongated joint member 610, which is movable in the front-and-rear direction (i.e., in a direction from the rotary center of the top cover 11 to the tip end thereof, and a well-known driving mechanism which moves the joint member 610 rearward in association with the closing movement of the top cover 11.

The joint member 610 is formed with a plurality of joint holes 611 an 612, to which the joint protrusions 361 of the plurality of holders 300 engage, are formed. Among the plurality of joint holes 611 and 612, the front side three joint holes 611 are formed to be circular, while the rearmost side joint hole 612 is formed to be an elongated hole. That is, the rearmost joint hole 612 and the rearmost joint protrusion 612 are configured to engage with each other with a play.

With the above configuration, when the top cover 11 is opened from the closed position, the front side three LED units 40 incline similarly, but the rearmost LED unit 40 inclines by a smaller angle than the others due to the play. Therefore, interference of the rearmost LED unit 40 with the discharge tray 11B can be suppressed.

Since a part of the joint holes (e.g., the rearmost joint hole 612) is formed to be an elongated hole, if the top cover 11 is quickly closed from the opened position, there is a possibility that the rearmost LED unit 40 may interfere with the top cover 11 since the movement of the rearmost joint protrusion 361 is allowed due to the play. To avoid such a problem, according to the exemplary embodiment, at inner portions in the right-and-left direction of the holder, third regulation parts 370 protruding in front-upper direction (i.e., toward the tip end of the top cover 11) are provided.

Therefore when the top cover 11 is quickly closed and the rearmost LED unit 40 largely rocks, the third regulation parts 370 contact the top cover 11 and the rotational movement of the LED unit 40 can be restricted. According to the exemplary embodiment, in view of commoditization of the shape of members, the third regulation parts 370 are provided to all the holder 300. The invention needs not be limited to such a configuration, and such third regulation parts 370 may be provided to only the holder(s) 300 which engages with the interlocking mechanism 600 with play.

It is noted that the invention needs not be limited to the configurations described above referring to the exemplary embodiment, and can be modified in various ways without departing from the scope of the invention as exemplified below.

In the exemplary embodiment, as the engaging part, the protruded parts 234 engage with the grooves 252 formed on the end portions of the rotation shaft 250. The invention needs not be limited to this configuration, and the engaging part may include a radially protruding portion formed at the end portions of the rotation shaft and a recess of opening that engages with the radial protrusion.

According to the exemplary embodiment, as metal members, the wires 261, 262 and 263 are employed. The invention needs not be limited to such a configuration, and a metal plate may be employed instead. However, it is advantageous in using the wires since lightweight can be realizes by using the wires in comparison with the metal plate.

According to the exemplary embodiment, as an exposure unit, a plurality of LED arrays arranged in a line are used. However, the invention needs not be limited to such a configuration. The light source may be EL (electro-luminescent) elements, or fluorescent bodies. For example, a plurality of rows of LED units each has a plurality of LED arrays aligned in the right-and-left direction may be used. For another example, a single light emitting element such as an LED or a fluorescent light, and a plurality of optical shutters (LCD or PLZT elements) arranged in the right-and-left direction may be employed. Further, a belt-type photoconductive member may be employed instead of the photoconductive drum 51.

As the light source of the exposure unit, instead of the LED, EL (electro-luminescence) elements, fluorescent bodies may be employed. Further, an object exposed to the light from the exposure unit needs not be limited to the photoconductive drum, and may be of other type (e.g., a belt-type photoconductive member).

According to the exemplary embodiment, the invention is applied to the color printer 1. However, the invention needs not be limited to such a configuration, and the can be applied to other image forming apparatuses such as a copier and a multi-function peripherals.

What is claimed is:

1. An image forming apparatus, comprising:

a main frame having an opening and includes a frame side first positioning part; and a cover rotatably supported by the main frame, the cover being rotatable between an opened position where the cover uncovers the opening and a closed position where the cover closes the opening, wherein the cover includes:

an exposure unit having a plurality of light emitting elements; and a holding member, holds the exposure unit, wherein the exposure unit includes:

a unit side first positioning part configured to be abutted to the frame side first positioning part, the unit side first positioning part is positioned in an auxiliary scanning direction between the main frame and the exposure unit when the unit side first positioning part contacts the frame side first positioning part; and a first engaging part having a curved surface, wherein the holding member has a first regulation part having a recessed portion in which the first engaging part is configured to be received, and wherein the exposure unit is movable in the auxiliary scanning direction with respect to the holding member as the first engaging part is disengaged from the first regulation part when the cover is located at the closed position, and wherein movement of the first engaging part in the auxiliary scanning direction is restricted as the first engaging part enters in the first regulation part and supported thereby when the cover is located at the opened position and the exposure unit is swingable about the first engaging part when the cover is located at the opened position.

2. The image forming apparatus according to claim 1, wherein the exposure unit has a second engaging part which is formed at a position displaced, with respect to the first engaging part, toward an optical axis of light emitted from the exposure unit, and wherein the holding member has a second regulation part configured to restrict movement of the second engaging part in the auxiliary scanning direction such that a movable amount of the second engaging part in the auxiliary scanning direction when the cover is located at the closed position is smaller than the movable amount of the second engaging part in the auxiliary scanning direction when the cover is located at the opened position.

3. The image forming apparatus according to claim 2, further comprising an urging member, between the holding member and the exposure unit, configured to urge the exposure unit in the auxiliary scanning direction to make the second engaging part contact the second regulation part.

4. The image forming apparatus according to claim 3, wherein the frame side first positioning part is formed with a first boss configured to engage with an upper portion of the unit side first positioning part from one side in the auxiliary scanning direction and a second boss configured to engage with a lower portion of the unit side first positioning part from the other side in the auxiliary scanning direction, wherein one of the holding member and the exposure unit is formed with a relief part configured to absorb a rocking movement of the exposure unit restricted by contact of the second engaging part with the second regulation part when the cover is located at the closed position, and wherein the urging member is configured to urge the exposure unit at a position higher than a position where the exposure unit contacts the first boss.

5. The image forming apparatus according to claim 3, wherein the urging member is configured to generate an urging force having a component in a direction of a moving direction of the exposure unit when the cover is moved from the opened position to the closed position.

6. The image forming apparatus according to claim 3, wherein the urging member comprises a torsion spring one end of which is engaged with the holding member and the other end is engaged with the exposure unit.

7. The image forming apparatus according to claim 6, wherein the exposure unit has a unit side second positioning part, positioning of the exposure unit with respect to the main frame in a main scanning direction being completed when the unit side second positioning part is abutted against a frame side second positioning part formed on the main frame, and wherein the torsion spring is configured to urge the exposure unit in the main scanning direction so that the unit side second positioning part is abutted against the frame side second positioning part.

8. The image forming apparatus according to claim 1, which is provided with a plurality of the holding members and a plurality of the exposure units.

9. The image forming apparatus according to claim 8, wherein the plurality of the holding members are configured to rotate, with an interlocking mechanism operable in association with opening/closing movement of the cover, the plurality of the exposure units such that tip ends or the plurality of the exposure units approach the rotational center of the cover, respectively, when the cover is moved from the closed position to the opened position, wherein a plurality of joints between the plurality of holding members with the interlocking mechanism are formed using a plurality of protrusions and a plurality of holes respectively corresponding to the plurality of protrusions, wherein one of the plurality of joints corresponding to one of the plurality of holding members is configured such that the protrusion and the hole of the one of the plurality of joints engage with each other with a play, and wherein portions of the one of the plurality of holding members at inner sides, in the main scanning direction, from both ends, third regulation parts are formed, the third regulation parts being configured to protrude toward the tip end of the cover, a rotational movement of the one of the plurality of holding members being restricted as the third regulation parts contact the cover.

10. An image forming apparatus, comprising:

a main frame having an opening;

a cover rotatable between an opened position where the cover uncovers the opening and a closed position where the cover closes the opening;

a holder rotatably supported by the cover and having a recess; and an exposure unit having a plurality of light emitting elements and a supporting wall, and held by the holder, the supporting wall having a first engaging portion which engages with the recess of the holder when the cover is located at the opened position, and which disengages from the recess of the holder when the cover is located at the closed position.

11. The image forming apparatus according to claim 10, wherein the holder has a regulation wall, and wherein the supporting wall of the exposure unit has a second engaging portion opposite to the first engagement portion in an emitting direction of the light emitting elements, and wherein the second engaging portion engages the regulation wall of the holder when the cover is located at the opened position, and disengages from the regulation wall of the holder when the cover is located at the closed position.

12. The image forming apparatus according to claim 11, wherein the main body has a first protrusion, and wherein the exposure unit is configured to expose a photosensitive drum having a rotation axis extending in an axial direction, and has a second protrusion which engages the first protrusion and restricts the movement of the exposure unit in a first direction perpendicular to the axial direction and an emitting direction of the light emitting elements when the cover is located at the closed position.

* * * * *